US006181250B1

(12) United States Patent
Brooks, Jr.

(10) Patent No.: US 6,181,250 B1
(45) **Date of Patent: *Jan. 30, 2001**

(54) HEAT DETECTION SYSTEM AND METHOD

(75) Inventor: William K. Brooks, Jr., Newport News, VA (US)

(73) Assignee: Southeastern Universities Research Assn., Inc., Newport News, VA (US)

( * ) Notice: Under 35 U.S.C. 154(b), the term of this patent shall be extended for 0 days.

This patent is subject to a terminal disclaimer.

(21) Appl. No.: 09/280,463

(22) Filed: Mar. 30, 1999

(51) Int. Cl.[7] ..... G08B 17/12
(52) U.S. Cl. ..... 340/577; 340/584; 340/632
(58) Field of Search ..... 340/577, 632, 340/633, 634, 628, 584, 581, 586, 588, 589

(56) References Cited

U.S. PATENT DOCUMENTS 3,906,743 * 9/1975 Le Vine ..... 340/577
4,332,770 * 6/1982 Ishida et al. ..... 422/78
4,443,793 * 4/1984 Hall, Jr. ..... 340/634
4,542,640 * 9/1985 Clifford ..... 73/23
4,640,628 * 2/1987 Seki et al. ..... 340/577
5,119,987 * 6/1992 Kobayashi ..... 236/49.3
5,428,964 * 7/1995 Lobdell ..... 340/632
5,618,496 * 4/1997 Hasumi et al. ..... 340/634
5,729,207 * 3/1998 Yamano ..... 340/628
5,798,945 * 8/1998 Benda ..... 340/310.01
5,841,021 * 11/1998 De Castro et al. ..... 72/23.2
5,896,088 * 4/1999 Brooks, Jr. ..... 340/632

* cited by examiner

*Primary Examiner*—Nina Tong

(57) ABSTRACT

The present invention describes a method for the detection of heat, incipient fire or combustion comprising the steps of: 1) incorporating a temperature-specific indicating agent which emits a specific detectable gas upon attainment of a predetermined temperature in an area where heat or incipient fire is to be detected, 2) providing a gas detector capable of detecting the specifically detectable gas emitted from the temperature-specific indicating agent; 3) detecting the specifically detectable gas; and 4) providing a warning or alarm when the specifically detectable gas reaches a predetermined concentration in the area. There is also disclosed a heat or incipient fire detection system comprising a temperature-specific indicating agent which emits a specific detectable gas upon attainment of a predetermined temperature and a detector for the specifically detectable gas.

6 Claims, 1 Drawing Sheet

HEAT DETECTION SYSTEM AND METHOD

FIELD OF THE INVENTION

Figure 1:
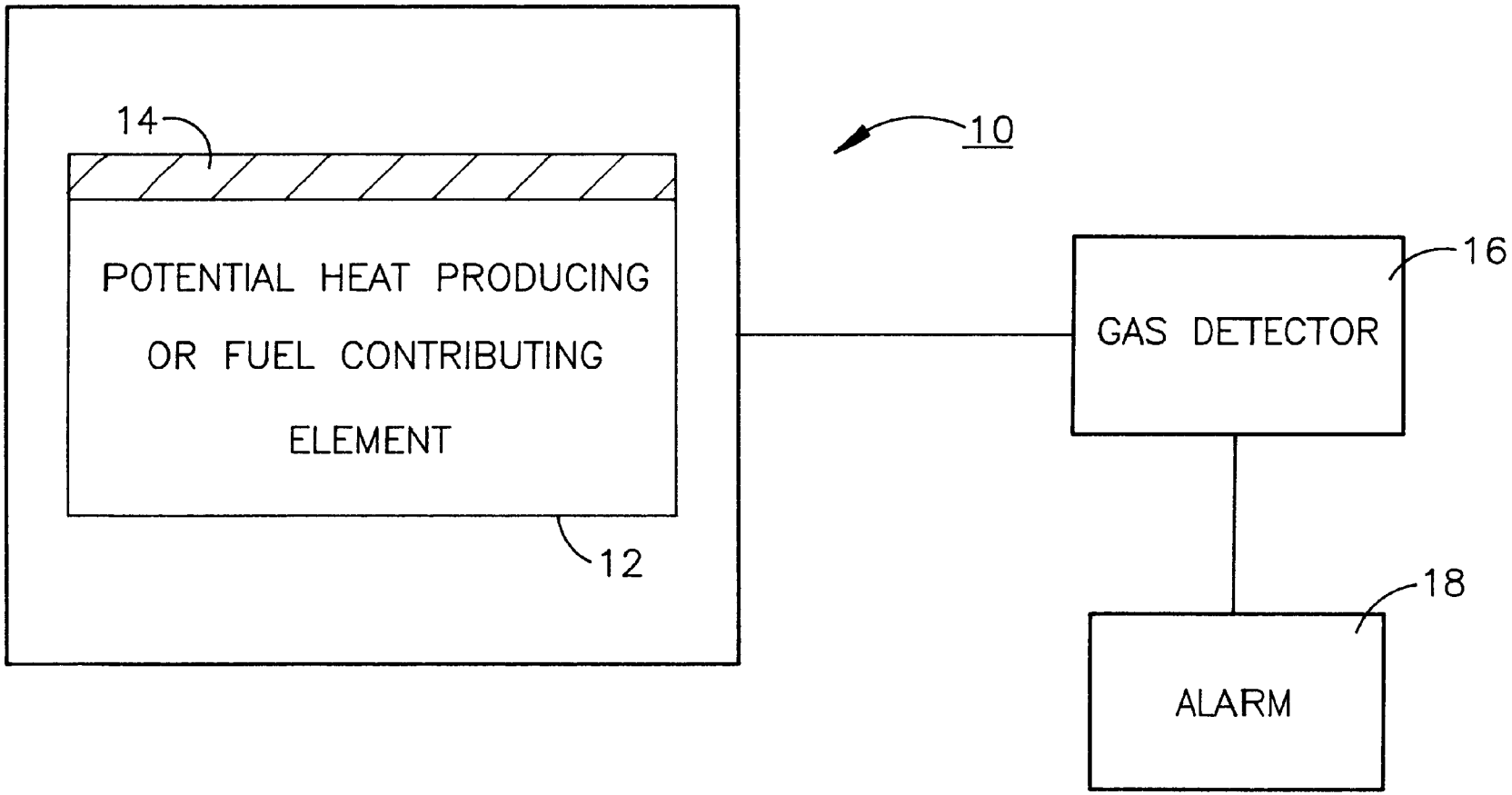

The present invention relates to heat detection systems and more particularly to fire detection systems that are capable of detecting conditions that indicate the approach of conditions that could result in combustion.

BACKGROUND OF THE INVENTION

Fire detection systems for the protection of personnel and property have spawned an entire industry dedicated to the manufacture, sale and installation of systems that provide early warning of the existence of combustion. The most common of these is, of course, the smoke detector, that relies on some sort of optical or ion detector to indicate the presence of smoke. Other systems, such as sprinklers, utilize the heat of combustion to trigger a warning and to inundate an area with a fire-extinguishing medium.

While such systems are highly useful and protective of personnel and property, they serve only to detect combustion after it has occurred. Consequently, a number of systems have been designed and built to detect incipient combustion. One such system designed and operated by Fermi National Laboratory, relies on an early warning system based on an evolved gas signature. Incipient detection systems of this type tend to be site specific due to their mode of operation. Such systems generally operate according to the following steps: 1) an analysis of likely ignition (combustion) scenarios and of the combustible fuels in a given area is performed; 2) the most likely fuel or combination of fuels to initiate combustion is determined; 3) a literature search is performed to determine what gases are given off by this material or combination of materials when heated; 4) detectors for these gases are obtained and either located in the area of interest for protection or connected to a gas sampling system capable of delivering the objective gas to the detector; and 5) upon detection of a predetermined concentration level of the objective/analyte gas an alarm is indicated. While such systems are entirely satisfactory for certain environments, they tend to be site specific, i.e. dependent upon the contents of the particular area of concern, and their installation tends to be time consuming and virtually a separate research project as all combustibles in the area must be characterized, their relative combustibility determined and suitable detection means and apparatus obtained and installed. Also, the introduction, intentionally or otherwise of an "uncharacterized" fuel(s) may negate the value of the entire system.

Yet another method used to detect incipient combustion involves the use of simple temperature detection devices. In such systems, simple thermometric devices or more sophisticated IR temperature sensors are placed proximate the potential source or sources of combustion and upon the attainment of a predetermined temperature an alarm or warning is instituted. Again, these systems are very useful and entirely appropriate for certain applications, however, they are generally not capable of providing coverage of large areas since the thermometer or other temperature sensing device must be located or "focused" in or on a particular small area where combustion is anticipated to occur. Such temperature sensing systems that monitor relatively large areas, are generally not capable of detecting a suitable, detectable temperature rise until after combustion has been initiated. Similarly, while such simple temperature detection systems based upon thermometric devices of one sort or another are capable of detecting the temperature rise of an entire area, they are not well suited to detecting potential temperature rises in a large number of small potential heat sources without the installation of numerous temperature detecting devices.

SUMMARY OF THE INVENTION

According to the present invention there is provided a method for the detection of heat, or incipient fire or combustion comprising the steps of: 1) incorporating a temperature-specific indicating agent which emits a specific detectable gas upon attainment of a predetermined temperature in an area where incipient fire is to be detected, 2) providing a gas detector capable of detecting the specifically detectable gas emitted from the temperature-specific indicating agent; 3) detecting the specifically detectable gas; and 4) providing a warning or alarm when the specifically detectable gas reaches a predetermined concentration.

As will be appreciated more fully upon reading of the detailed description below, systems of the type described herein are suitable for use in remote areas where human presence is either not practical or permissible for safety or other reasons, are capable of covering relatively large areas, are not site specific, can be relatively inexpensively manufactured and disseminated, and, in fact, can be used to detect temperature rise even in an area which is generally maintained "cold", i.e. below room temperature. In brief, the method of the present invention allows for inexpensive monitoring of the temperature of potential fuels, independent of the type of potential fuel, over the entire area of the potential fuel surface.

FIG. 1 shows a drawing of the invention.

DETAILED DESCRIPTION OF THE INVENTION

The method of the present invention is designed to address the problem of receiving early warning of the presence of conditions suitable for the initiation of combustion or the presence of excessive heat in a monitored area or location.

FIG. 1 shows an area of detection 10, potential heat producing or fuel contributing element 12, temperature specific indicationg agent 14, gas detector 16 and warning or alarm 18.

While commercial smoke detectors and sprinkler systems are appropriate for indicating the presence of combustion, they are not adequate to indicate incipient combustion. Localized temperature monitors of various types typically are incapable of covering the entire fuel surface area. Prior art systems for the detection of incipient combustion are typically site and content specific and difficult and expensive to design and install.

According to the present invention there is provided a method for the detection of incipient fire, heat or combustion comprising the steps of: 1) incorporating a temperature-specific indicating agent which emits a specific detectable gas upon attainment of a predetermined temperature in an area where incipient fire or heat is to be detected, 2) providing a gas detector capable of detecting the specifically detectable gas emitted from the temperature-specific indicating agent; 3) detecting the specifically detectable gas; and 4) providing a warning or alarm when the specifically detectable gas reaches a predetermined concentration.

The principal operative agents in the method of the present invention are: 1) a temperature-specific indicating agent; and 2) a gas detector capable of detecting gases emitted by the temperature-specific indicating agent at the levels and in the environment of use that will permit the signaling of an alarm that conditions are ripe for combustion to occur unless corrective action is taken, or that a predetermined temperature threshold has been surpassed.

The temperature-specific indicating agent may be any chemical compound that begins to decompose, react or otherwise undergo a change of condition that results in the release of a detectable gas upon attainment of a predetermined temperature. Incorporation of such a chemical composition may be by any of a number of means. For example, the composition may be painted or otherwise applied to the surface of an element, device, piece of equipment, or potential fuel source that is expected to generate heat in a failure condition and/or to provide a source of fuel in a combustion situation. An example of such an application would be the coating of electrical cables with an appropriate such composition such that upon heating of the cables beyond a predetermined temperature, a readily detectable gas is released for detection.

Alternatively and where and when appropriate, the temperature-specific indicating agent may be incorporated into the element, device, piece of equipment or potential fuel source. An example of such an application would be incorporation of a suitable temperature-specific indicating agent into the polymeric coating of an electrical cable such that upon heating of the cable to a predetermined temperature, a detectable gas is released for detection, and sounding of an alarm. In yet another alternative embodiment, the temperature-specific indicating agent might be applied to the electrical cable as a separate and final extruded coating.

The method of incorporation of the temperature-specific indicating agent is not critical so long as it is in sufficient proximity to the potential fuel source or source of heat that it emits a detectable gas when the appropriate predetermined temperature has been attained.

A wide range of gas detection devices can be utilized in the method of the present invention. These range from simple and relatively inexpensive detectors such as those commonly used for the detection of elevated levels of CO (carbon monoxide) in the home, to very sophisticated devices such as FTIR (Fourier Transform Infrared) detectors which are capable of detecting very low levels of very complex molecules even against a background of numerous and varied other gases. The choice of device will depend entirely on the particular gas released by the temperature-specific indicating agent and the conditions against which detection must occur. For example, in an environment of normally low levels of CO a simple device will be adequate, but in an environment of relatively high ambient levels of numerous gases, a more complex or sophisticated detector may be necessary such as an FTIR spectroscope or gas chromatograph. A suitable highly sophisticated gas sampling and analysis system suitable for use in the method and system of the present invention is described in co-pending U.S. patent application Ser. No. 08/840,745 filed Apr. 16, 1997 whose teachings are incorporated herein by reference.

In application, the method of the present invention comprises incorporating an appropriate temperature-specific indicating agent into the area to be monitored by any suitable method including, but not limited to, those mentioned above. Selection of the particular temperature-specific indicating agent will of course be dictated by the conditions within the monitored area and the temperature at which gas generation is to be initiated. A gas detection device suitable for detecting the particular released gas at the concentration levels anticipated within the monitored area is then selected and placed in the monitored area. The gas detection device is then connected to an alarm or alerting device such that upon detection of a threshold level of the emitted gas a warning is provided that corrective action should be taken.

The method of the present invention provides several inherent advantages over the various heat and combustion sensing systems of the prior art. Among these advantages are: 1) the system response at the gas evolving temperature is predictable independent of the potential combustion fuel type; 2) existing installations containing potential fuels can be readily retrofitted, for example by painting, coating or otherwise; 3) the system is extremely flexible in that the method can be applied in a wide range of environments and at a wide range of costs ranging from systems suitable for general household use to critical industrial or military applications; 4) the temperature at which the system produces a detectable alarm can be readily "tuned" to a given application, for example, in incipient fire situations the critical temperature can be much lower than that achieved with smoke detection systems and in fact, a system could be designed to detect excessive heat in systems which normally operate in a cold environment such as in refrigerated rooms, and 5) the system monitors temperature over the entire area of the potential fuel or source of heat.

The following example describes one of the virtually endless number of applications and methods of implementation of the method and system of the present invention.

EXAMPLES

Several simple examples of such a system can be visualized. In on such case, a specific heavy gas is used to foam a temperature-sensitive plastic, producing a lightweight coating with many small bubbles of the gas. This could be formed into sheets or other convenient shapes, or applied directly to the fuel in liquid form and allowed to cool. The plastic can be chosen to be one that softens or melts at a particular temperature or within a particular temperature range; such plastics are currently used in temperature-sensing devices. When the local temperature rises, the plastic melts, and the gas in the bubbles escapes and is detected by the gas detector. The gases in this application could be relatively inert, non-diffusing gases such as nitrous oxide, sulphur hexafluoride, or hexafluropropylene; the selection being based upon the anticipated ambient conditions. While these are examples of non-toxic, non-flammable gases, one might also use a very low concentration of a toxic or flammable gas to facilitate low-level detection, especially in unoccupied areas. Heavier hydrocarbon gases, for example, can be detected at extremely low concentrations. The bubbles could also be filled with a stable organic liquid or solid with a low melting temperature or high vapor pressure, rather than gas, thus potentially increasing the signal size by a significant amount. Specific liquids or gases can be selected on the basis of the ambient temperature of the system being monitored.

In the above examples, the gas or low boiling exists in its final form, encapsulated by a material that undergoes a physical change when heated. Another example utilizes a temperature-specific agent that undergoes a chemical reaction that is triggered by the elevated temperature. For example, polyvinyl chloride (PVC), a common plastic that emits hydrogen chloride gas when heated significantly above a predetermined temperature, can be use as an integral plastic coating on the monitored fuel source or could take the form of finely divided plastic particles that are suspended in a material that will adhere to a desired surface. For instance, a mixture of powdered PVC and fire-retardant paint can be used to protect an existing fuel source. The mixture is painted on the fuel source providing a stable layer of material that emits hydrogen chloride gas when heated. The detection of hydrogen chloride gas is a well-developed science, since PVC is a common toxic gas.

In both of the foregoing examples, the system can be made more robust by incorporating two or more gaseous components. The primary advantage of this approach would be to avoid single-detector false alarms. The fire alarm would be based on the positive simultaneous detection of two gas types. This allows the use of somewhat noisier detector technology, potentially reducing the overall system cost.

It is intended that the descriptions contained herein are illustrative only and that other variations and modifications of the invention will be apparent to the skilled artisan. Accordingly, it is intended that the scope of the invention be limited only by the scope of the appended claims.

What is claimed is:

1. A method for detection of heat, or incipient fire or combustion comprising the acts of:

1) incorporating a temperature-specific indicating agent is achieved by coating thereof on a potential heat producing or fuel contributing element present in the area; and said temperature-specific indicating agent emits a non-naturally occurring specific detectable gas upon attainment of a predetermined temperature in an area where heat generation or incipient fire is to be detected;

2) providing a gas detector capable of detecting the specifically detectable gas emitted from the temperature-specific indicating agent;

3) detecting the concentration level of said specifically detectable gas with the gas detector; and 4) providing a warning or alarm when the concentration level of said specifically detectable gas reaches a predetermined concentration in the area.

2. The method of claim 1 wherein incorporation of the temperature-specific indicating agent is achieved by inclusion thereof in the structure of a potential heat producing or fuel contributing element present in the area.

3. The method of claim 1 wherein the gas detector is a Fourier Transform Infrared spectroscope.

4. The method of claim 1 wherein the detectable gas is carbon monoxide.

5. A system for the detection of heat or incipient combustion in a monitored area comprising:

a) in the area being monitored a temperature-specific indicating agent is achieved by coating therof on a potential heat producing or fuel contributing element present in the area; and said temperature-specific indicating agent emits a non-naturally occuring detectable gas upon attainment of a predetermined temperature;

b) a mechanism for conducting said detectable gas to a gas detector;

c) said gas detector capable of detecting the detectable gas upon release in the monitored area by virtue of the indicating agent having attained the predetermined temperature; and for detecting the concentration level of said detectable gas;

d) a mechanism for providing an indication that said detectable gas has been detected by said detector in said monitored area, and said concentration level of said detectable gas reaches a predetermined concentration in the area.

6. The system of claim 5 wherein said detector is a Fourier Transform Infrared spectroscope.

* * * * *